United States Patent [19]

Lucke

[11] 4,124,171

[45] Nov. 7, 1978

[54] CONTRACTABLE WINDING MANDREL

[75] Inventor: Florian Lucke, Mengen, Fed. Rep. of Germany

[73] Assignee: Croon & Lucke Maschinenfabrik GmbH & Co., KG, Mengen, Fed. Rep. of Germany

[21] Appl. No.: 830,645

[22] Filed: Sep. 6, 1977

[30] Foreign Application Priority Data

Sep. 29, 1976 [DE] Fed. Rep. of Germany ..... 2643747

[51] Int. Cl.[2] ..... B65H 54/64; B65H 75/24

[52] U.S. Cl. ..... 242/2; 242/110.1

[58] Field of Search ..... 242/110.1, 110.2, 110, 242/127, 118.32, 118.41, 2, 3, 53

[56] References Cited

U.S. PATENT DOCUMENTS

| | | | |
|---|---|---|---|
| 1,220,974 | 3/1917 | Gebhart | 242/110.2 |
| 1,246,130 | 11/1917 | Macready | 242/110.2 |
| 2,535,188 | 12/1950 | Beckner | 242/118.32 |
| 2,636,695 | 4/1953 | Bixby | 242/118.41 |
| 3,421,712 | 1/1969 | Scroggie et al. | 242/127 |
| 3,825,196 | 7/1974 | Yamazaki | 242/110.1 |

FOREIGN PATENT DOCUMENTS

| | | | |
|---|---|---|---|
| 1,038,787 | 5/1953 | France | 242/110.2 |
| 172,782 | 12/1921 | United Kingdom | 242/2 |

*Primary Examiner*—George F. Mautz
*Attorney, Agent, or Firm*—Shenier & O'Connor

[57] ABSTRACT

A contractable winding mandrel for forming yarn balls or the like and comprising a fit-on piece mounted upon a shaft, first arms articulated thereon, struts rotatably connected to the said arms and arranged generally parallel to the shaft, and second arms which are pivotably connected to the struts at their one ends and having their other ends pivotably mounted in a head piece which is slidable parallel and coaxially to the shaft, so that when the spacing between the fit-on piece and the head piece is increased or reduced the radial spacing of the struts can be reduced or increased respectively, wherein the outside surfaces of the fit-on piece and of at least the second arms are made rough and/or uneven to prevent slipping of yarn upon the mandrel when the spacing between the fit-on piece and the head piece is increased.

4 Claims, 3 Drawing Figures

CONTRACTABLE WINDING MANDREL

This invention relates to a contractable winding mandrel for forming yarn balls or the like, particularly a mandrel comprising a fit-on piece mounted upon a shaft, first arms articulated thereon, struts rotatably connected to the said arms and arranged generally parallel to the shaft, and second arms which are pivotally connected to the struts at their one ends and having their other ends pivotably mounted in a head piece which is slidable parallel and coaxially to the shaft, so that when the spacing between the fit-on piece and the head piece is increased or reduced the radial spacing of the struts can be reduced or increased respectively.

Winding mandrels of this type are fitted with their shaft into tension chucks that can be rotated by a motor in ball winding machines. They are wound with yarn or the like in their expanded condition, the spacing between the fit-on piece and the head piece being reduced and the radial spacing of the struts thus increased. In being wound the fed-in yarn runs over not only the struts, which lie generally parallel to the shaft, but also partly over the fit-on piece and over the arms, which lie obliquely to the shaft, and more particularly over the second arms which are connected with the head piece.

Once the ball has been completed, the winding mandrel is contracted, i.e. the radial spacing of the struts is reduced by increasing the spacing between the fit-on piece and the head piece. This causes the whole ball to be stretched, on the one hand, and its purchase on the winding mandrel, which now has a reduced diameter, to be weakened, on the other, so that the ball can be easily pulled off the winding mandrel, possibly with an application of a paper band, without any appreciable frictional resistance. In the aforesaid stretching of the ball just before its removal from the mandrel the wound layers upon the fit-on piece and the arms will naturally undergo a tensioning, which causes these wound layers to slip from the indicated positions towards the centre of the ball, which makes the appearance of the skein unsightly owing to the yarn loops hanging about it.

It is an object of the present invention to provide a winding mandrel which overcomes this disadvantage.

The present invention provides a contractable winding mandrel for forming yarn balls or the like and comprising a fit-on piece mounted upon a shaft, first arms articulated thereon, struts rotatably connected to the said arms and arranged generally parallel to the shaft, and second arms which are pivotably connected to the struts at their one ends and having their other ends pivotably mounted in a head piece which is slidable parallel and coaxially to the shaft, so that when the spacing between the fit-on piece and the head piece is increased or reduced the radial spacing of the struts can be reduced or increased respectively, wherein the outside surfaces of the fit-on piece and of at least the second arms are made rough and/or uneven to prevent slipping of yarn upon the mandrel when the spacing between the fit-on piece and the head piece is increased.

With the winding mandrel according to the invention even after the stretching of the skein the windings placed upon the fit-on piece and the arms are firmly held in position which they retain substantially unchanged even after the ball has been taken off the mandrel.

The invention will be further described, by way of example only, with reference to the accompanying drawings, in which.

Figure 1:
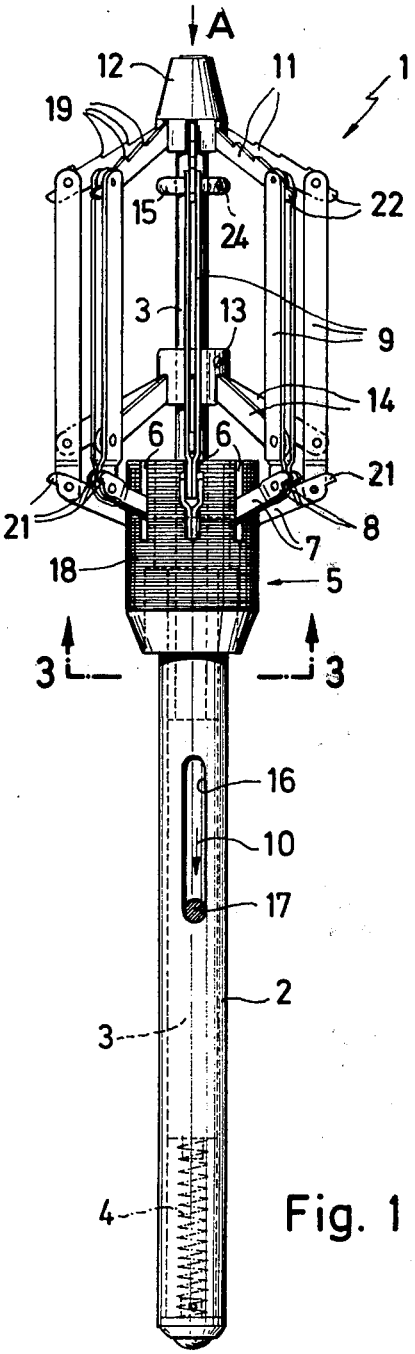
FIG. 1 is a side view of a contractable winding mandrel according to the invention in its expanded condition.
Figure 2:
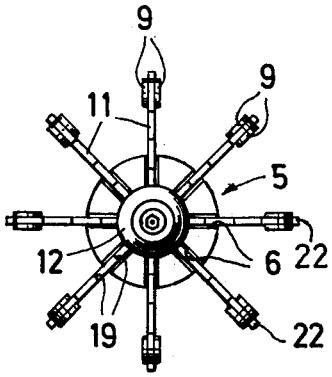
FIG. 2 is a plan view taken in the direction of the arrow A in FIG. 1.

The winding mandrel 1 shown in FIG. 1 includes a hollow shaft 2, which is insertable in a known manner into a tension chuck, which can be rotated by a motor, of a ball winding machine. Slidable inside the shaft 2 is a rod 3, which projects from the shaft 2 at its upper end with a reduced diameter, and at its lower end is loaded by a pressure spring 4 which urges the rod upwards in FIG. 1. To provide a passage for the rod 3, there is provided on the shaft 2 a fit-on piece 5 having eight radially directed slots 6. A first arm 7 is articulatedly mounted in each slot 6 and is pivotable in the associated radial plane, the arm, as particularly seen in FIG. 3, being provided at its end projecting from the slot with a fork 8. Struts 9, which run parallel to the axis of the shaft 2 and of the rod 3, are rotatably connected with the forks 8 and, like the arms 7, are formed in two layers and so bent as to be able to receive, at their ends remote from the arms 7, second arms 11 which are there pivotably mounted at their one ends to the struts 9. The other ends of the second arms 11 are pivotably mounted in a corresponding radial slot in a head piece 12 which is provided at the free end of the rod 3.

A ring 13 is solidly united with the part of the rod 3 that projects free from the shaft 2, and on this ring are rotatably mounted in radial slots cross trusses 14, the free ends of which are engaged between and rotatably united with the two layers of each strut 9. Further, an annular spacer 15 is rigidly fitted onto the rod 3 between the head piece 12 and the ring 13.

FIG. 1 shows the winding mandrel in its expanded condition, in which yarn is wound upon it into a ball. The expanded condition of the winding mandrel is obtained by reducing the spacing between the fit-on piece 5 and the head piece 12 by moving the rod 3 in the shaft 2 against the pressure of the spring 4 in the direction of the arrow 10. In practice this is effected by providing the shaft 2 which a longitudinal slot 16 and the rod 3 with a bore coincident with the slot 16, an actuating pin 17 by means of which the rod 3 can be moved inside the shaft 2 against the action of the spring 4 being insertable into the bore from the outside. As the rod 3 and thus the head piece 12 are moved in the direction of the arrow 10, the arms 7 and 11 snap out radially outwards from the fit-on piece and the head piece respectively and entrain the struts 9, the radial distance of which from the rod 3 is thus increased. The total effect of this operation is to increase the diameter of the winding mandrel about the struts 9. Once a ball or the like has been wound upon the expanded winding mandrel, the rod 3 is slid relative to the shaft 2 against the arrow 10, whereby the spacing between the fit-on piece 5 and the head piece 12 is increased and the diameter of the mandrel in the vicinity of the struts 9 is decreased. As a result the ball sits only loosely upon the mandrel and can be easily pulled off.

To prevent the slipping of yarn layers wound about the arms 11 and the fit-on piece 5 as the ball is stretched by the increased spacing between the fit-on piece 5 and the head piece 12, the surfaces of the arms 11 and of the fit-on piece 5 are made rough and uneven. In the illustrated embodiment the fit-on piece 5 is provided with a channelling or knurling 18 (see FIG. 1), while the arms 11 have teeth or barbs 19. This shape prevents the slipping of the winding layers upon the arms 11 and the fit-on piece 5 when the ball is stretched.

In another embodiment the first arms 7 may also be provided with teeth or barbs, which, unlike the teeth or barbs 19 of the arms 11, are directed downwards.

As illustrated, the arms 7 and 11 project in the expanded condition of the winding mandrel (FIG. 1) with extensions 21 and 22 respectively beyond the struts 9. These extensions 21 and 22 also serve to prevent collapse of the wound layers over the struts when the winding mandrel is contracted.

Figure 3:
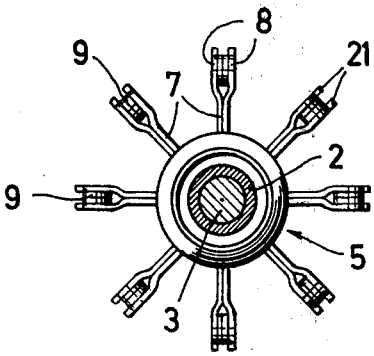
FIG. 3 is a sectional view taken along the line 3—3 in FIG. 1.

As seen particularly from FIG. 3, a comparatively wide flat area is formed in the region of the forks 8 provided on the arms 7, the forks enclosing the two layers of the struts 9 which are in mutual contact. It has been found that this design prevents the thread from entering between the arms and the struts 9 in this region and becoming jammed there, which considerably contributes to the trouble-free operation of the winding mandrel.

The winding mandrel can be contracted until the arms 11 come into contact with the spacer 15, fixed correspondingly high upon the rod 3. The spacer 15 has rounded edges and its position upon the rod 3 is adjustable by loosening and tightening a set screw 24. When the mandrel 1 is closed the struts 9 may assume a slightly conical attitude.

When the winding mandrel is being contracted or closed the longitudinal struts 9 are kept away from it and from the ring 13 (as well as the rod 3) owing to the spacer 15, which is in contact with the arms 11. Consequently, the inwardly located yarn layers cannot become clamped there by the struts 9 and held back when the ball is removed from the mandrel. This represents a considerable advantage over conventional winding mandrels, in which jammed, inner thread layers were often pulled out when the ball was removed, making the skein commercially unusable. This advantage, arising from the position of the spacer 15, is otherwise quite independent from the form of the outside surfaces of the fit-on piece 5 and of the arms 7 and 11.

I claim:

1. In a contractable winding mandrel for forming yarn balls and comprising a fix-on piece mounted upon a shaft, first arms articulated thereon, struts rotatably connected to said arms and arranged generally parallel to the shaft, and second arms which are pivotally connected to the struts at their one ends and having their other ends pivotally mounted in a head piece supported on a rod extending axially outwardly of said shaft and which is slidable parallel and coaxially to the shaft, so that when the spacing between the fit-on piece and the head piece is increased or reduced the radial spacing of the struts can be reduced or increased respectively and a ring slidable on said rod pivotally receiving first ends of cross trusses the other ends of which are pivotally connected to the respective struts, the improvement comprising that the outside surface of the fit-on piece is provided with a knurling and at least the second arms are provided with teeth to prevent slipping of yarn upon the mandrel when the spacing between the fit-on piece and the head piece is increased, and a spacer mounted on said rod at a location at which said second arms bear thereagainst when the mandrel is contracted, the radial dimension of said spacer being such as to space said struts from said rod and from said ring when said second arms bear against said spacer.

2. A winding mandrel according to claim 1, wherein the first arms are also provided with teeth.

3. A winding mandrel according to claim 1, wherein each strut is two-layered and wherein each first arm at its articulated joint with the respective strut encloses the latter with a fork formed on said first arm.

4. A winding mandrel as in claim 1 including means for adjustably securing said spacer to said rod.

* * * * *